US011211725B2

(12) United States Patent
Chen et al.

(10) Patent No.: US 11,211,725 B2
(45) Date of Patent: Dec. 28, 2021

(54) MULTIPOLAR CONNECTOR

(71) Applicant: AAC Technologies Pte. Ltd., Singapore (SG)

(72) Inventors: Yongli Chen, Shenzhen (CN); Ya Wang, Shenzhen (CN); Hua Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/993,255

(22) Filed: Aug. 13, 2020

(65) Prior Publication Data

US 2020/0412039 A1 Dec. 31, 2020

Related U.S. Application Data

(63) Continuation of application No. PCT/CN2019/094052, filed on Jun. 30, 2019.

(51) Int. Cl.

| | |
|---|---|
| ***H01R 12/71*** | (2011.01) |
| ***H01R 12/55*** | (2011.01) |
| ***H01R 13/11*** | (2006.01) |
| ***H01R 13/502*** | (2006.01) |
| ***H01R 13/6585*** | (2011.01) |

(52) U.S. Cl.

CPC ..... *H01R 12/716* (2013.01); *H01R 12/55* (2013.01); *H01R 13/113* (2013.01); *H01R 13/502* (2013.01); *H01R 13/6585* (2013.01)

(58) Field of Classification Search

CPC ... H01R 12/716; H01R 13/504; H01R 13/405
USPC ..... 439/74, 701, 676, 607.34
See application file for complete search history.

(56) References Cited

U.S. PATENT DOCUMENTS

| | | | | |
|---|---|---|---|---|
| 6,503,101 | B1 * | 1/2003 | Yu | H01R 13/6597 439/607.36 |
| 8,888,506 | B2 * | 11/2014 | Nishimura | H01R 43/24 439/74 |
| 8,986,027 | B2 * | 3/2015 | Nishimura | H01R 12/707 439/181 |
| 10,361,519 | B2 * | 7/2019 | Chuang | H01R 13/41 |
| 10,644,419 | B2 * | 5/2020 | Ishida | H01R 13/6581 |
| 10,644,420 | B1 * | 5/2020 | Ishida | H01R 12/7088 |
| 10,651,581 | B1 * | 5/2020 | Sasayama | H01R 4/02 |
| 2005/0032400 | A1 * | 2/2005 | Zhang | H01R 12/716 439/74 |

(Continued)

*Primary Examiner* — Abdullah A Riyami
*Assistant Examiner* — Nelson R. Burgos-Guntin
(74) *Attorney, Agent, or Firm* — W&G Law Group

(57) ABSTRACT

A multipolar connector includes a first connector and a second connector. The first connector includes inner terminals arranged in columns and an insulating component holding the inner terminals. The second connector includes inner terminals arranged in columns and an insulating component holding the inner terminals. One of the first connector and second connector further includes an outer terminal connected to the ground potential and held by the insulating component. A shielding component extends from the outer terminal along a direction in which the columns of inner terminals extend and is held by the insulating component, and the shielding component is located between adjacent columns of inner terminals when the inner terminals of the first connector and second connector are in contact and engaged with each other. Compared with the related art, the multipolar connector of the present disclosure does not need to form the shielding component by separately insert-molding.

11 Claims, 13 Drawing Sheets

(56) References Cited

U.S. PATENT DOCUMENTS

2005/0042924 A1* 2/2005 Zhang ..... H01R 13/6582 439/607.36
2006/0063432 A1* 3/2006 Chen ..... H01R 13/658 439/607.36
2006/0276061 A1* 12/2006 Koguchi ..... H01R 12/725 439/74
2008/0207014 A1* 8/2008 Takeuchi ..... H01R 12/716 439/74
2008/0305657 A1* 12/2008 Midorikawa ..... H01R 43/0235 439/74
2009/0061655 A1* 3/2009 Miyazaki ..... H01R 12/57 439/74
2010/0068900 A1* 3/2010 Wu ..... H01R 12/716 439/74
2011/0263140 A1* 10/2011 Sato ..... H01R 13/6275 439/74
2013/0012039 A1* 1/2013 Nose ..... H01R 12/716 439/74
2015/0079816 A1* 3/2015 Suzuki ..... H01R 12/7082 439/74
2015/0140840 A1* 5/2015 Nishimura ..... H01R 13/6594 439/74
2015/0140841 A1* 5/2015 Watanabe ..... H01R 43/18 439/74
2015/0207248 A1* 7/2015 Takenaga ..... H01R 13/6582 439/74
2016/0036145 A1* 2/2016 Hasegawa ..... H01R 12/716 439/78
2016/0190719 A1* 6/2016 Brzezinski ..... H01R 12/73 439/74
2017/0033505 A1* 2/2017 Ozeki ..... H01R 12/716
2018/0175561 A1* 6/2018 Chen ..... H01R 12/52
2020/0044374 A1* 2/2020 Ishida ..... H01R 12/716
2020/0212635 A1* 7/2020 Chen ..... H01R 13/6471
2020/0335893 A1* 10/2020 Chen ..... H01R 12/716

* cited by examiner

MULTIPOLAR CONNECTOR

FIELD OF THE INVENTION

The present disclosure relates to the technical field of signal connection, and in particular to a multipolar connector formed by engagement of multi connectors.

BACKGROUND OF THE INVENTION

Nowadays, rapid development of electronic technology makes the electronic devices be widely used. A variety of circuit substrates with different functions are arranged in the electronic devices to meet user's various functional requirements for the electronic devices. Currently, a multipolar connector is generally used to electrically connect two circuit substrates.

A single connector of a conventional multipolar connector is consisted of inner terminals, an insulating component, and an outer terminal (metal housing). There is no shielding component inside of the connector, which leads to signal interference between the inner terminals; or, a shielding component is independently embedded in the insulating component and separated from the outer terminal, thereby affecting shielding and isolation effect to a certain extent. In addition, it is difficult to accurately locate the shielding component during separately inserting the shielding component into the insulating component.

Therefore, it is necessary to provide a new multipolar connector to solve the above technical problems.

SUMMARY OF THE INVENTION

The present disclosure provides a multipolar connector which comprises a first connector and a second connector. The first connector comprises a plurality of inner terminals arranged in a plurality of columns and an insulating component holding the inner terminals. The second connector comprises a plurality of inner terminals arranged in a plurality of columns and an insulating component holding the inner terminals. At least one of the first connector and second connector further comprises an outer terminal which is connected to a ground potential and held by the insulating component. A shielding component extends from the outer terminal along an extending direction of the columns of inner terminals and is held by the insulating component. The shielding component is located between the columns of inner terminals when the inner terminals of the first connector and second connector are in contact and engaged with each other.

Preferably, the shielding component comprises a first shielding part and a second shielding part which are arranged along the extending direction of the columns of inner terminals.

Preferably, the first shielding part and the second shielding part are in contact with each other.

Preferably, the shielding component has an integral structure.

Preferably, the outer terminal comprises a first outer terminal and a second outer terminal, and the shielding component is located between the first outer terminal and the second outer terminal.

Preferably, the first outer terminal and the second outer terminal cooperate to form a ring-shaped configuration surrounding the inner terminals.

Preferably, the outer terminal has a continuous ring-shaped configuration surrounding the inner terminals.

Preferably, only the first connector of the first and second connectors comprises the outer terminal and the shielding component, the insulating component of the first connector defines an annular-shaped groove, the groove divides the insulating component of the first connector into a peripheral portion and a central portion, the outer terminal is held by the peripheral portion, and the shielding component is held by the central portion; the insulating component of the second connector defines a slot, the central portion is received in the slot and a sidewall of the slot is inserted into the groove when the inner terminals of the first connector and second connector are in contact and mutual engaged with each other.

Compared with the related arts, the multipolar connector of the present disclosure integrates the shielding component and the outer terminal as one piece to avoid the issue that the shielding component is difficult to be accurately located when the shielding component is separately inserted into the insulating component (inaccurate location of the shielding component when the shielding component is separately inserted into the insulating component will weaken the shielding and isolation effect of shielding component), so as to improve the shielding effect.

BRIEF DESCRIPTION OF THE DRAWINGS

In order to more clearly explain the technical solutions of the embodiments of the present disclosure, drawings required in the description of the embodiments will be briefly introduced below. Obviously, the drawings in the following description are only embodiments of the present disclosure. For those of ordinary skill in the art, other drawings can also be obtained based on these drawings without paying any creative labor, in which.

DETAILED DESCRIPTION OF THE PREFERRED EMBODIMENTS

The technical solutions of the embodiments of the present disclosure will be described clearly and completely in conjunction with the drawings in the embodiments of the present disclosure. Obviously, the described embodiments are only part of embodiments of the present disclosure, but not all embodiments. Based on the embodiments of the present disclosure, all other embodiments obtained by a person of ordinary skill in the art without making creative labor fall within the protection scope of the present disclosure.

Embodiment I

Figure 1:
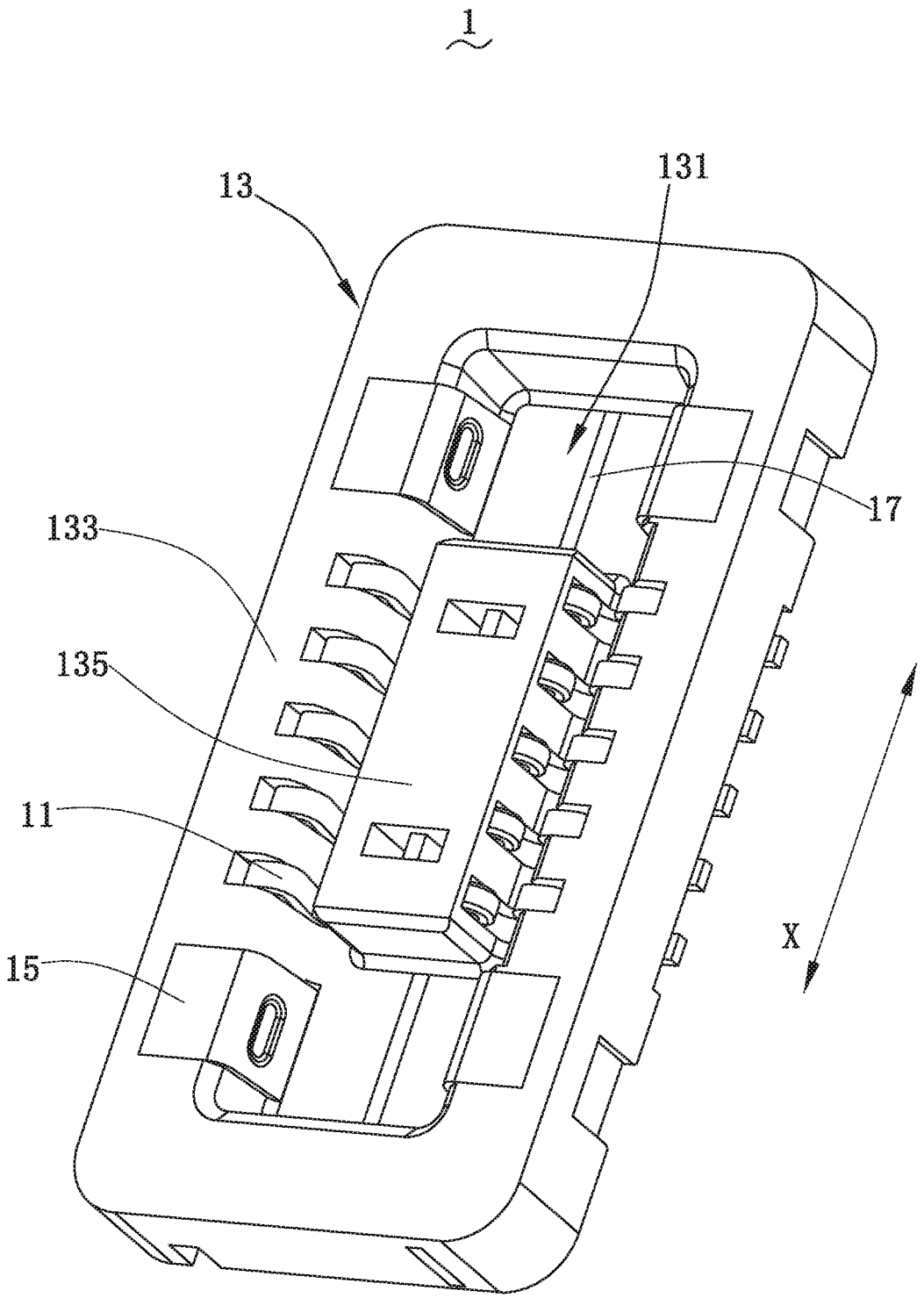
FIG. 1 is a schematic view of a first embodiment of a first connector.
Figure 4:
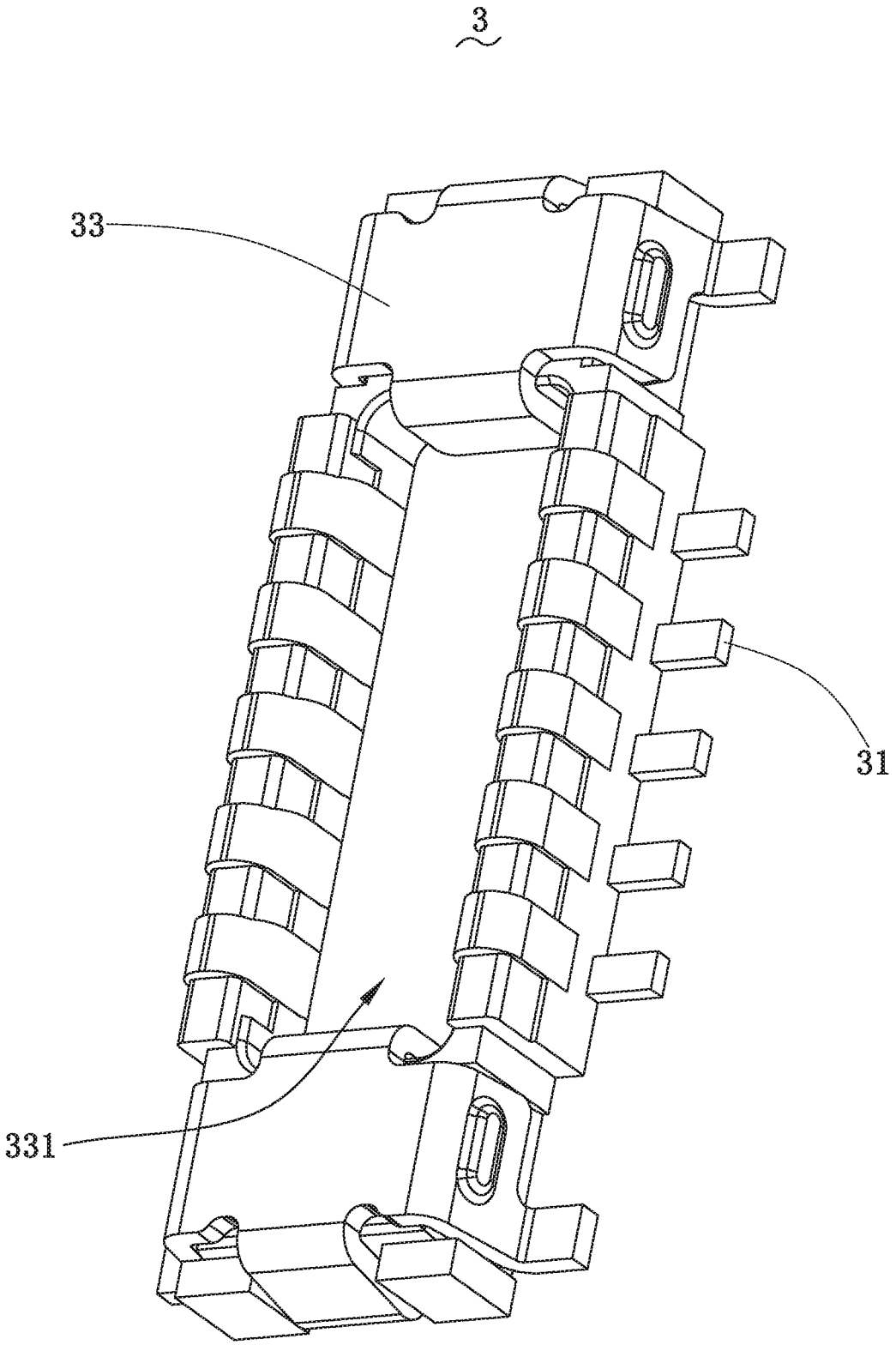
FIG. 4 is a schematic view of a first embodiment of a second connector.
Figure 6:
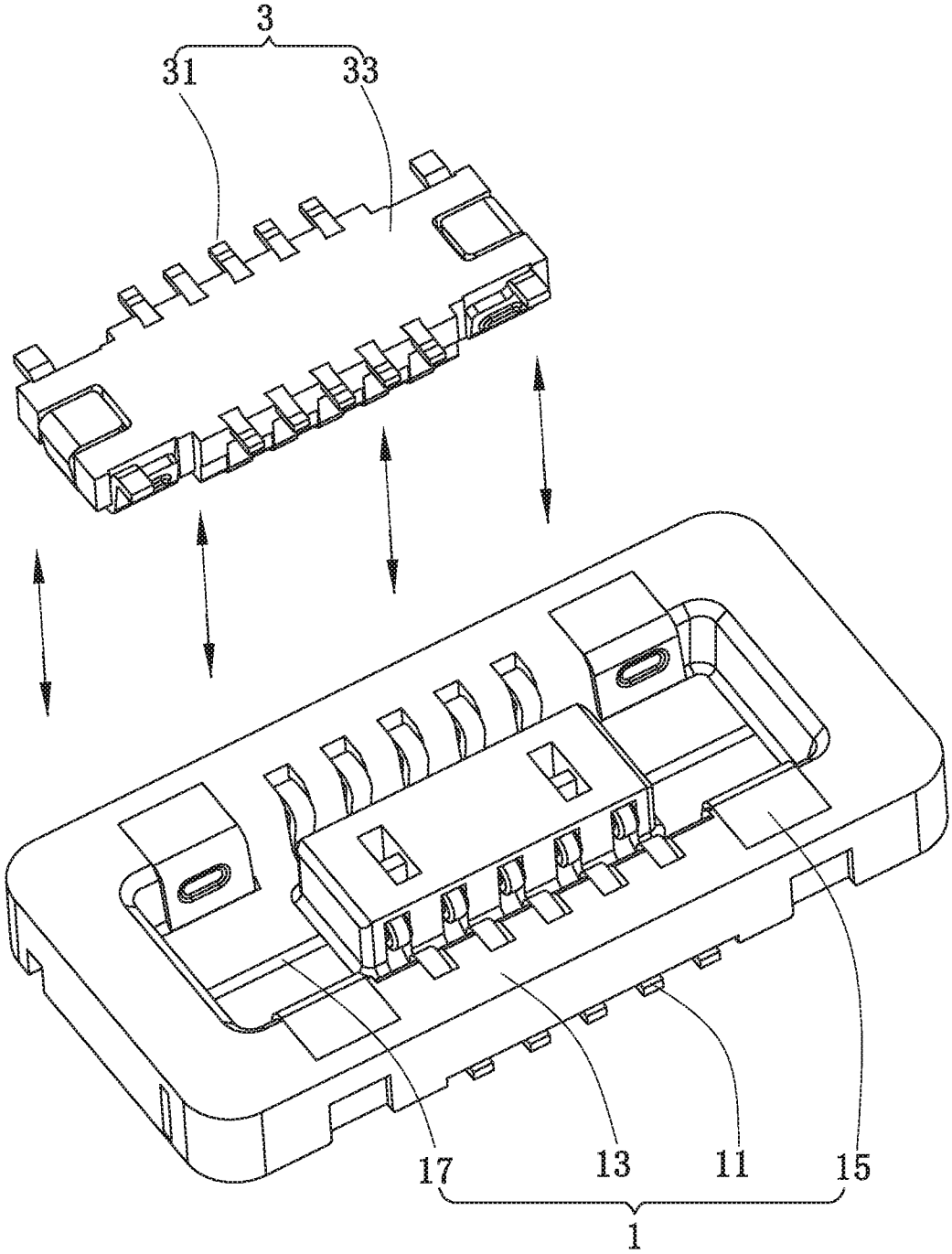
FIG. 6 is a schematic view showing a first embodiment of a multipolar connector at a state before engagement.
Figure 7:
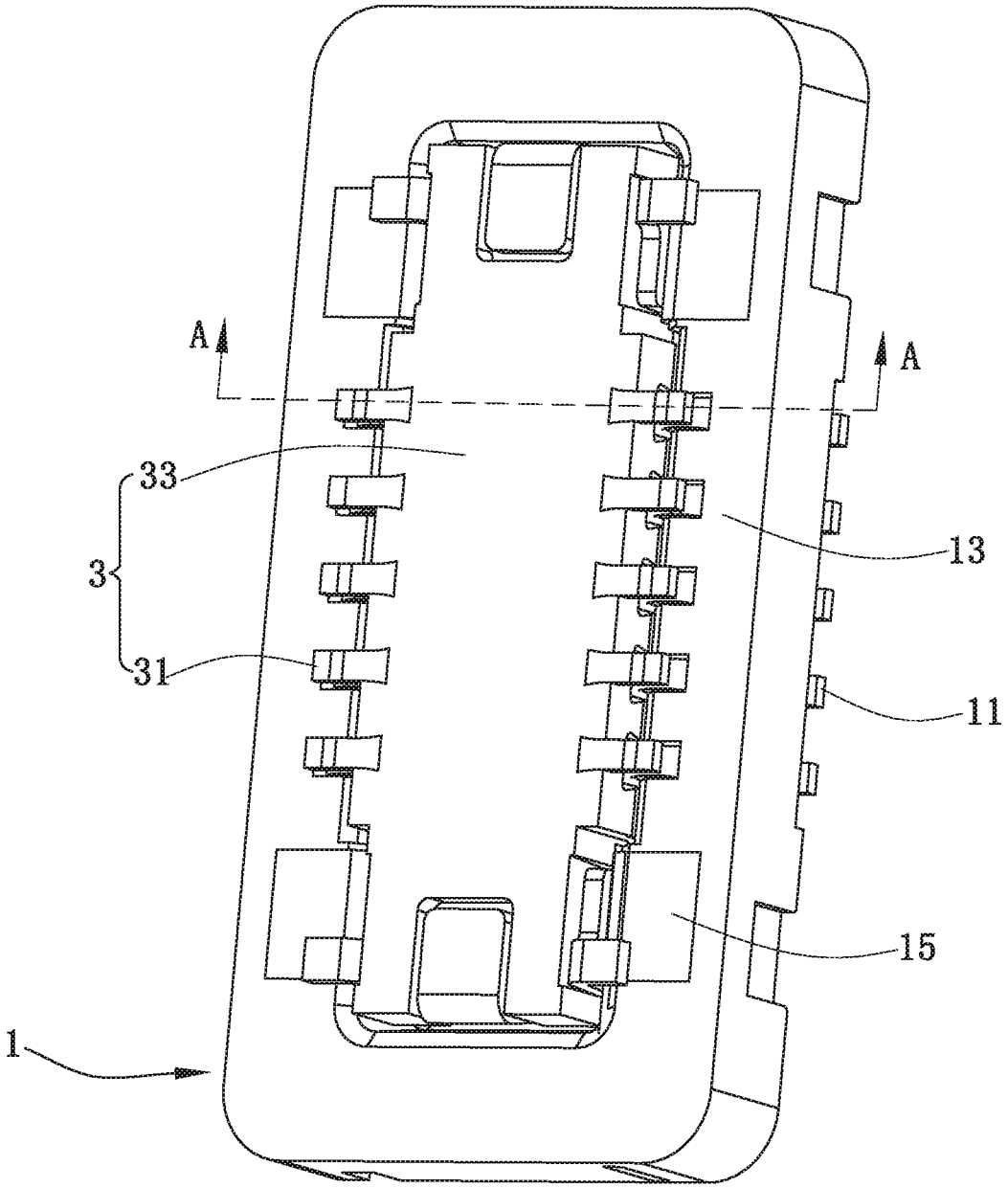
FIG. 7 is a schematic view showing the first embodiment of the multipolar connector at a state after engagement.

A multipolar connector as shown in FIG. 7 is formed by mutual engagement as shown in FIG. 6 of a first connector 1 as shown in FIG. 1 and a second connector 3 as shown in FIG. 4. The first connector 1 and the second connector 3 are connected to different circuit substrates (not shown), respectively. These circuit substrates are electrically connected by the multipolar connector which is formed by mutual engagement of the first connector 1 and the second connector 3.

Figure 2:
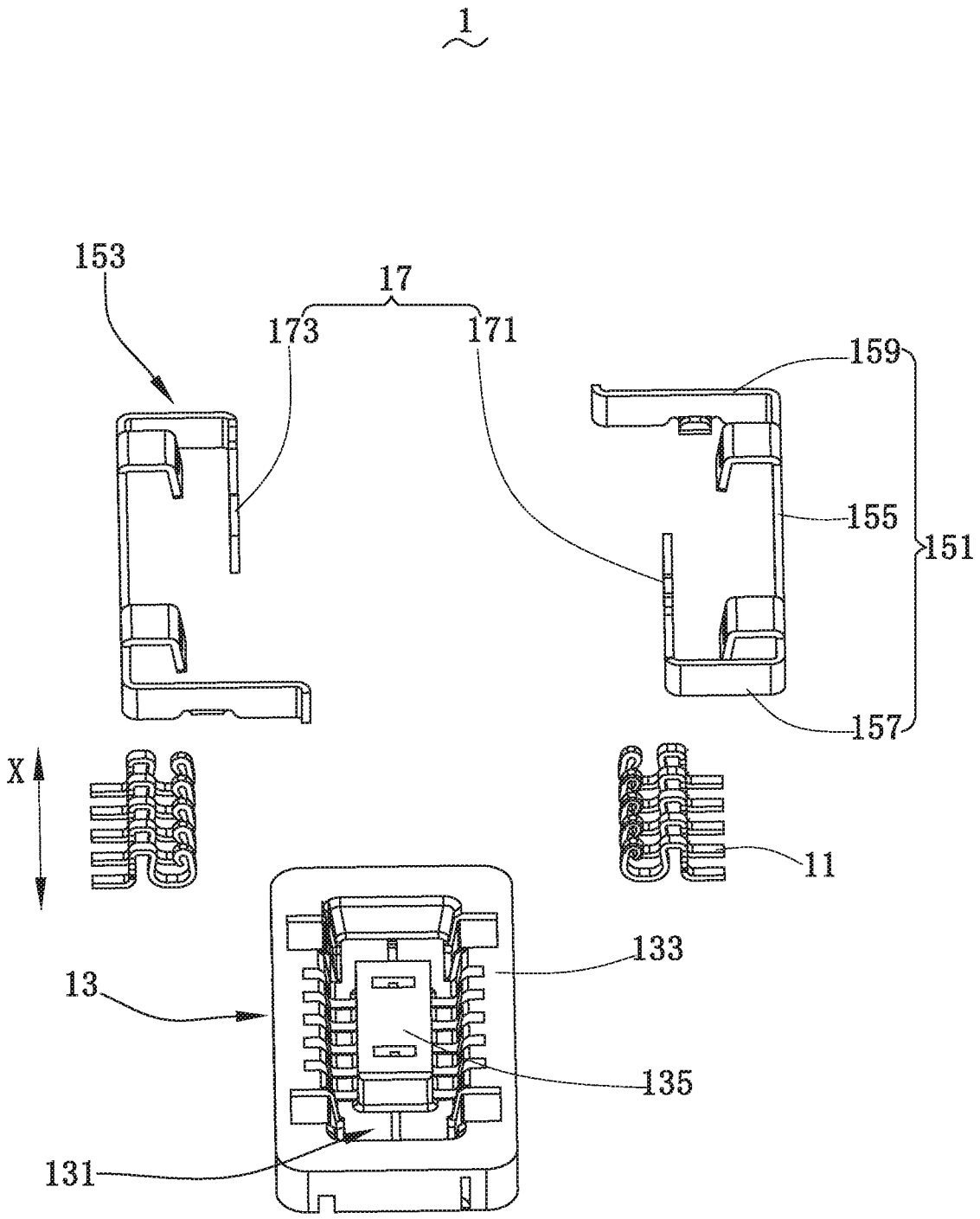
FIG. 2 is an exploded view of the first connector shown in FIG. 1.
Figure 3:
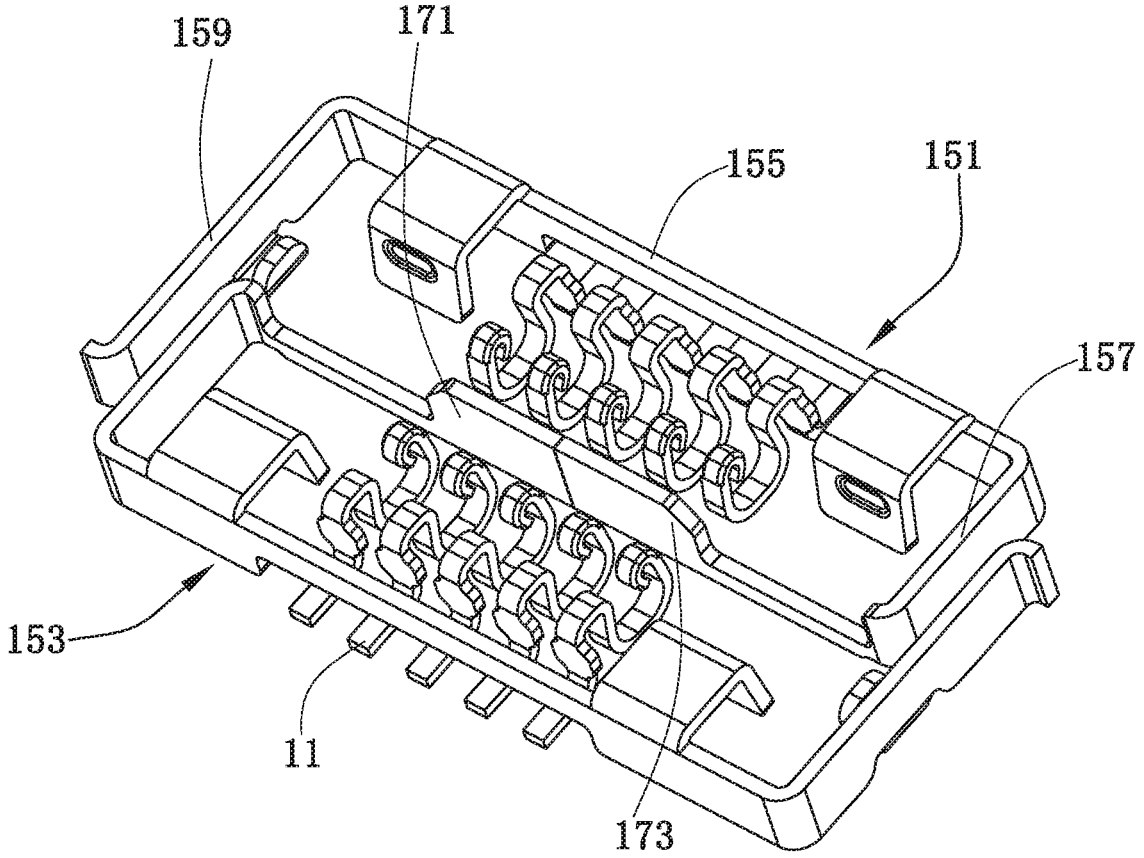
FIG. 3 is a schematic structural diagram of the first connector shown in FIG. 1 after removing an insulating component.

As shown in FIG. 1, FIG. 2 and FIG. 3, the first connector 1 includes a plurality of inner terminals 11, an insulating component 13, outer terminals 15 and a shielding component 17.

The plurality of inner terminals 11 are arranged in a plurality of columns, and each column has several inner terminals 11. In an exemplary embodiment as shown in FIG. 1 and FIG. 2, the plurality of inner terminals 11 are arranged in two columns, and each column is arranged with five inner terminals 11. An orientation of one column of inner terminals 11 is defined as the X direction (i.e., the X direction is the extending direction of the columns of inner terminals 11).

Figure 8:
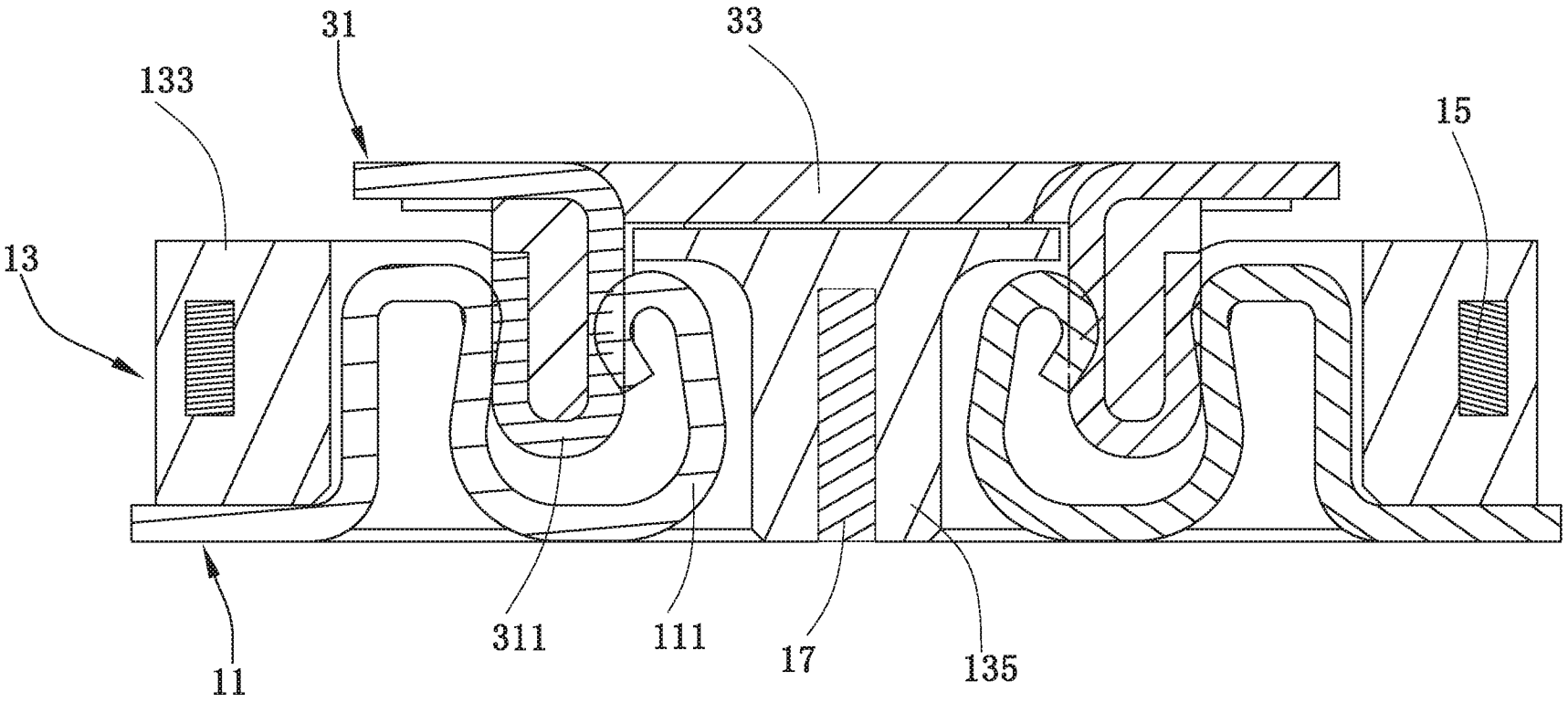
FIG. 8 is a cross-sectional view of the multipolar connector shown in FIG. 7 taken along A-A direction.

The plurality of inner terminals 11 are conductors which are configured to be electrically connected to the signal potential or the ground potential, respectively. The inner terminal 11 is formed by bending a rod-shaped conductive member. The inner terminal 11 is inserted and held in a slot of the insulating component 13. In a state that the first connector 1 and the second connector 3 are mutual engaged with each other as shown in FIG. 7 and FIG. 8, the inner terminals 11 of the first connector 1 are in contact with inner terminals 31 of the second connector 3 described later. By the contact of the inner terminals 11 and the inner terminals 31, the first connector 1 and the second connector 3 are electrically connected.

The insulating component 13 is an insulating member which integrally holds the plurality of inner terminals 11, the outer terminal 15, and the shielding component 17. The insulating component 13 can be made of a resin material. Of course, the insulating component 13 may also be made of other insulating materials. In this embodiment, the first connector 1 is manufactured by insert-molding of the plurality of inner terminals 11, the outer terminals 15, and the shielding component 17 in the insulating component 13.

In the exemplary embodiment as shown in FIG. 1 and FIG. 2, the insulating component 13 defines a ring-shaped groove 131. The groove 131 divides the insulating component 13 into a peripheral portion 133 and a central portion 135. The outer terminals 15 are held by the peripheral portion 133, and the shielding component 17 is held by the central portion 135.

The outer terminals 15 are held by the insulating component 13 and surround the plurality of inner terminals 11. The outer terminals 15 are conductors connected to the ground potentials. The outer terminals 15 are connected to the ground potentials to maintain at the ground potential, thereby shielding electromagnetic waves from an outside of the first connector 1 to make an interior of the first connector 1 to be an electrically shielded space, so that the plurality of inner terminals 11 are not subject to electromagnetic interference (EMI) from the outside of the connector under the shielding effect of the external terminal 15.

In an exemplary embodiment as shown in FIG. 2 and FIG. 3, the outer terminals 15 includes a first outer terminal 151 and a second outer terminal 153, and the shielding component 17 is located between the first outer terminal 151 and the second outer terminal 153. The first outer terminal 151 and the second outer terminal 153 are held by the insulating component 13. As shown in FIG. 3, the first outer terminal 151 and the second outer terminal 153 cooperate to form a ring-shaped configuration surrounding the plurality of inner terminals 11. The first outer terminal 151 and the second outer terminal 153 each include a longitudinal side 155 extending along the X-direction, and a first transverse side 157 and a second transverse side 159 extending from two ends of the longitudinal side 155. In some embodiments, the first transverse side 157 is closer to the inner terminals 11 relative to the second transverse side 159. In some embodiments, the first transverse side 157 is shorter than the second transverse side 159. The shielding component 17 extends from the first transverse side 157. The second transverse side 159 of the first outer terminal 151 faces and close to the first transverse side 157 of the second outer terminal 153. The second transverse side 159 of the second outer terminal 153 faces and close to the first transverse side 157 of the first outer terminal 151.

The shielding component 17 extends from the outer terminal 15 along the extending direction of the columns of inner terminals 11 (i.e., the X direction), and is held by the insulating component 13. That is, the shielding component 17 is integrated with the outer terminal 15. The shielding component 17 is a member configured for suppressing the EMI between the columns of inner terminals 11. As shown in FIG. 1 and FIG. 8, the shielding component 17 is held by the insulating component 13 and is located between the columns of inner terminals 11. By integrating the shielding components 17 and the outer terminal 15 as one piece, the shielding component 17 and the outer terminal 15 together maintain at the ground potential, making the shielding component 17 with the ground potential form a shield of electromagnetic waves, thereby restraining the EMI between the columns of inner terminals 11.

In the exemplary embodiment as shown in FIG. 2 and FIG. 3, the shielding component 17 includes a first shielding part 171 and a second shielding part 173, and the first shielding part 171 and the second shielding part 173 are opposite to each other along the extending direction of the columns of inner terminals 11 (i.e., the shielding component 17 is divided into two parts). As shown in FIG. 3, the first shielding part 171 extends from the first transverse side 157 of the first outer terminal 151 along the extending direction of the columns of inner terminals 11 (i.e., the X direction), and the second shielding part 173 extends from the first transverse side 157 of the second outer terminal 153 along the extending direction of the columns of inner terminals 11 (i.e., the X direction).

In the exemplary embodiment as shown in FIG. 3, the first shielding part 171 and the second shielding part 173 are aligned with and in contact with each other. Alternatively, the first shielding part 171 and the second shielding part 173 can be separated from each other. In the case of the first shielding part 171 and the second shielding part 173 being separated from each other, electromagnetic shielding can be constructed when the first shielding part 171 and the second shielding part 173 are close to each other. Therefore, electromagnetic coupling (EMC) generated by the space between the first shielding part 171 and the second shielding part 173 can be broken, and the EMI between the columns of inner terminals 11 can be restrained.

Figure 5:
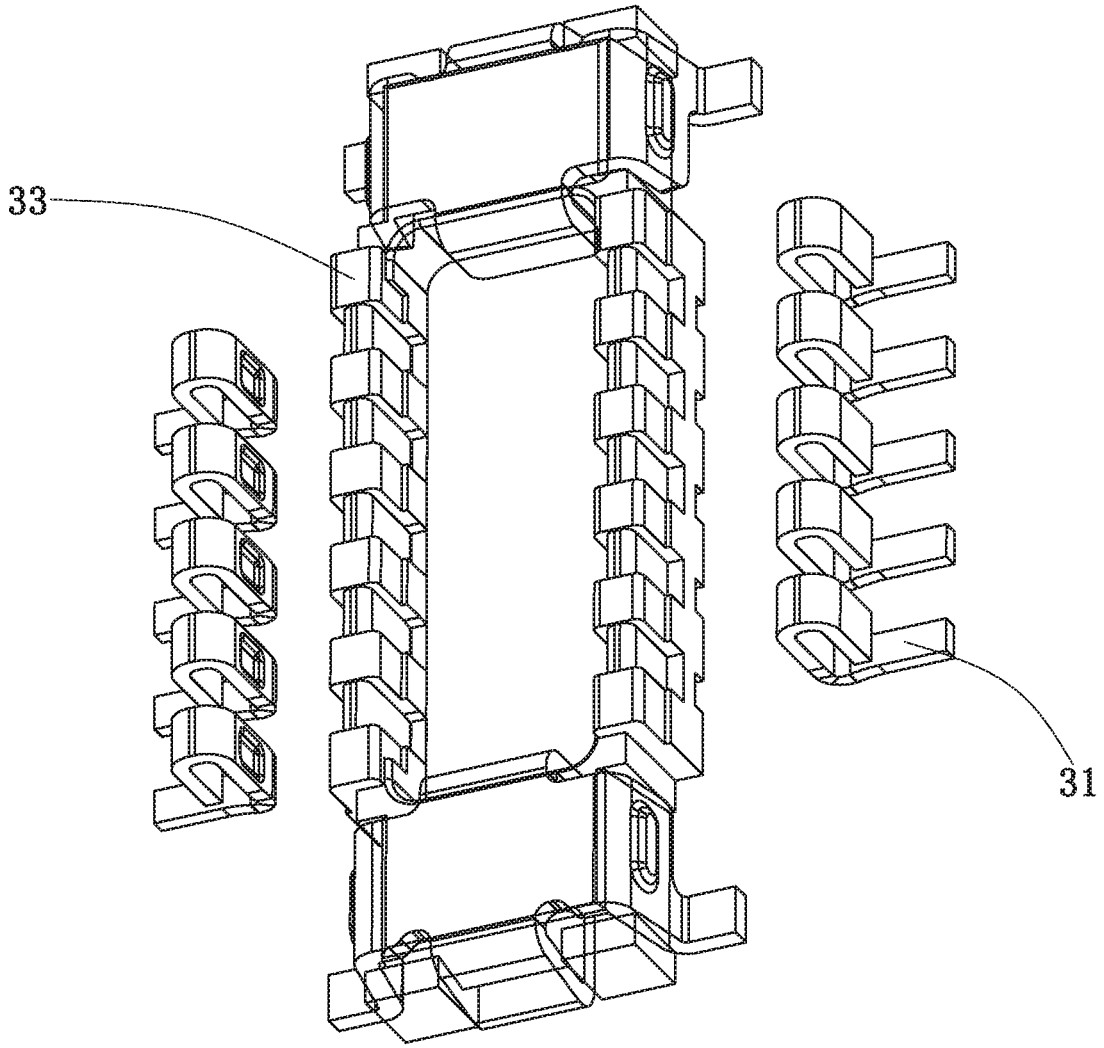
FIG. 5 is an exploded view of the second connector shown in FIG. 4.

As shown in FIG. 4 and FIG. 5, the second connector 3 includes a plurality of inner terminals 31 and an insulating component 33.

The inner terminals 31 are conductors that contact the inner terminals 11 of the first connector 1 described above, and are held by the insulating component 33. The inner terminal 31 is formed by bending a rod-shaped conductive member.

Each of the inner terminals 31 corresponds to one of the inner terminals 11 of the first connector 1. More specifically, the plurality of inner terminals 31 are also arranged in two columns, each column is arranged with five inner terminals 31, and each inner terminal 31 is in contact with the one corresponding inner terminal 11.

The insulating component 33 is an insulating member that holds the plurality of inner terminals 31. The insulating component 33 can be made of resin. Of course, the insulating component 33 can be made of other insulating materials.

The insulating component 33 defines a slot 331. As shown in FIG. 8, in a state that the inner terminals 11, 31 of the first connector 1 and second connector 3 are in contact and mutual engaged with each other, the central portion 135 of the insulating component 13 of the first connector 1 is received in the slot 331. A sidewall of the slot 331 is inserted into the groove 131 of the insulating component 13. By the arrangement of the groove 131 and the slot 331, in the state that the inner terminals 11, 31 of the first connector 1 and second connector 3 are in contact and mutual engaged with each other:

the outer terminal 15 of the first connector 1 not only surrounds the plurality of inner terminals 11 of the first connector 1, but also surrounds the plurality of inner terminals 31 of the second connector 3, which makes the plurality of inner terminals 31 be not subject to the EMI from the outside of the connector under the shielding effect of the external terminal 15 of the first connector 1; and the shielding component 17 is further used to restrain the EMI between the columns of inner terminals 31. As shown in FIG. 8, the shielding component 17 is also located between the columns of inner terminals 31. In the multipolar connector, especially when the inner terminals 11, 31 transmit high-frequency signals, it is easy to generate EMI between the columns of inner terminals 11, 31. By providing the shielding component 17 between the columns of inner terminals 11, 31 to form a shield of electromagnetic waves, the EMI between the columns of the inner terminals 11, 31 can be restrained, and particularly a signal transmission performance of the multipolar connector in high-frequency applications can be improved.

FIG. 8 shows the state that the inner terminals 11 of the first connector 1 and the inner terminals 31 of the second connector 3 are in contact and mutual engaged with each other.

As shown in FIG. 8, the inner terminal 11 of the first connector 1 has a concave portion 111 formed at an end thereof near the shielding component 17 of the first connector 1, which is recessed along a direction away from the inner terminal 31 of the second connector 3. Correspondingly, the inner terminal 31 of the second connector 3 has a convex portion 311 corresponding to the concave portion 111 of the inner terminal 11 which is formed at an end thereof near the shielding component 17 of the first connector 1.

At the engagement state shown in FIG. 8, the convex portion 311 of the inner terminal 31 is inserted into and in contact with the concave portion 111 of the inner terminal 11. The inner terminal 11 of the first connector 1 or/and the inner terminal 31 of the second connector 3 are made of deformable elastic materials (such as phosphor bronze). When the convex portion 311 of the inner terminal 31 is inserted into the concave portion 111 of the inner terminal 11, the concave portion 111 is deformed to expand outwardly (i.e., the inner terminal 11 being made of deformable elastic materials) or/and the convex portion 311 is deformed to contract inwardly (i.e., the inner terminal 31 being made of deformable elastic materials). Due to the concave portion 111 or/and the convex portion 311 intends to return to its original shape (i.e., the shape of the concave portion 111 or/and the convex portion 311 before insertion), a clamping force is generated between the concave portion 111 and the convex portion 311 to make the concave portion 111 firmly clamp the convex portion 311. Under the action of such force, the inner terminal 11 of the first connector 1 and the inner terminal 31 of the second connector 3 are engaged.

Embodiment II

Figure 9:
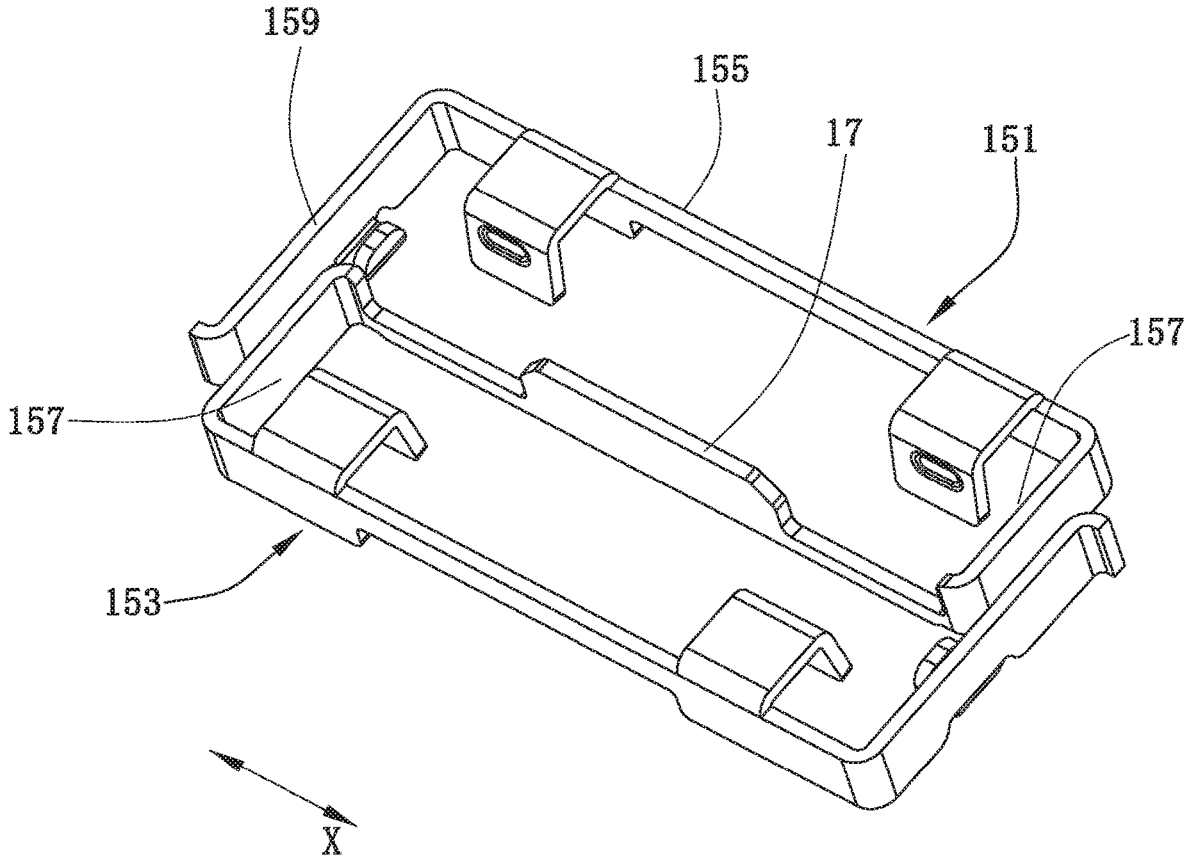
FIG. 9 is a schematic structural diagram of a second embodiment of a first connector.

As shown in FIG. 9 which only shows the shielding component and the outer terminal, the difference between the second embodiment and the first embodiment is as following: the shielding component 17 of the second embodiment has an integral structure, and both ends of the shielding component 17 are integrated to the first transverse side 157 of the first outer terminal 151 and the first transverse side 157 of the second outer terminal 153, respectively. In other words, the first outer terminal 151, the second outer terminal 153, and the shielding component 17 are integrally formed as one piece.

Embodiment III

Figure 10:
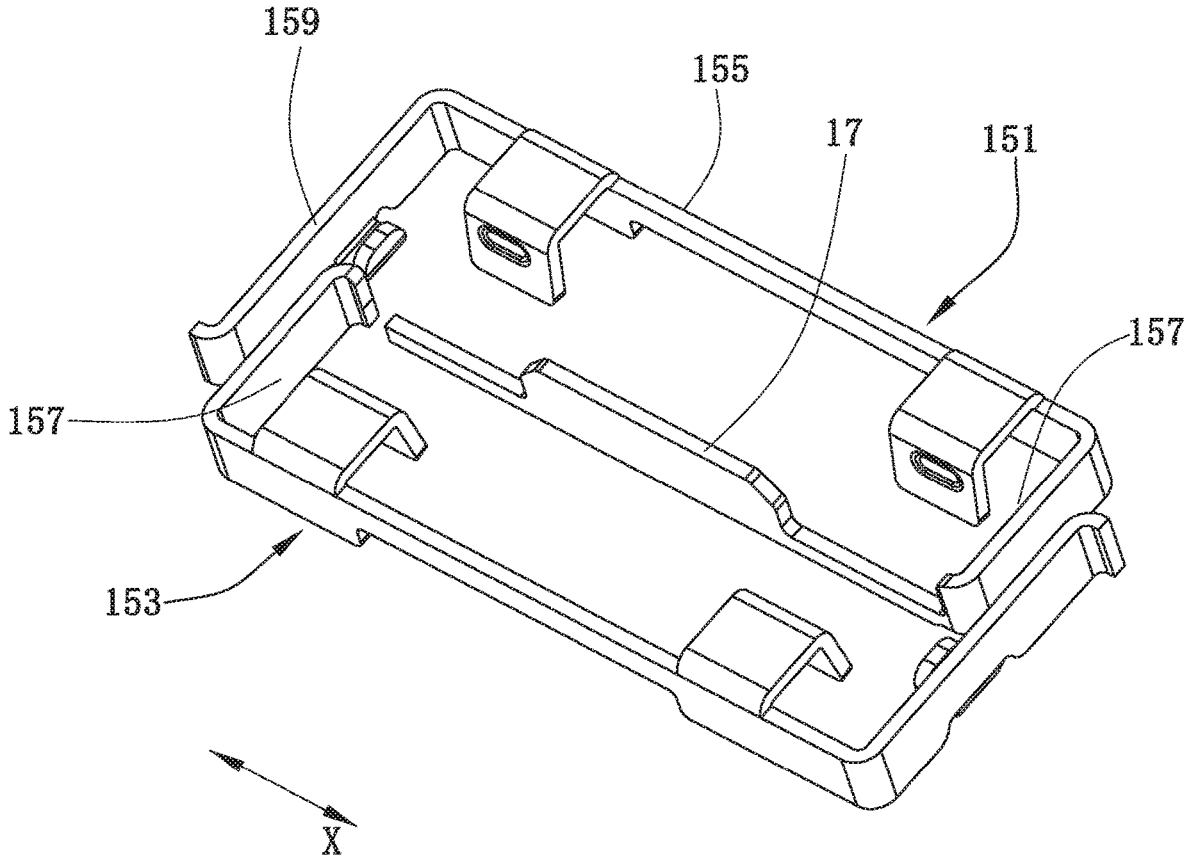
FIG. 10 is a schematic structural diagram of a third embodiment of a first connector.

As shown in FIG. 10 which only shows the shielding component and the outer terminal, the difference between the third embodiment and the second embodiment is as following: the shielding component 17 extends from the first transverse side 157 of the first outer terminal 151 to the first transverse side 157 of the second outer terminal 153 along the X direction. An end of the shielding component 17 away from the first transverse side 157 of the first outer terminal 151 can be separated from the first transverse side 157 of the second outer terminal 153, or can be in contact with the first transverse side 157 of the second outer terminal 153. In other words, the first outer terminal 151 and the shielding component 17 are integrally formed as one piece.

Embodiment IV

Figure 11:
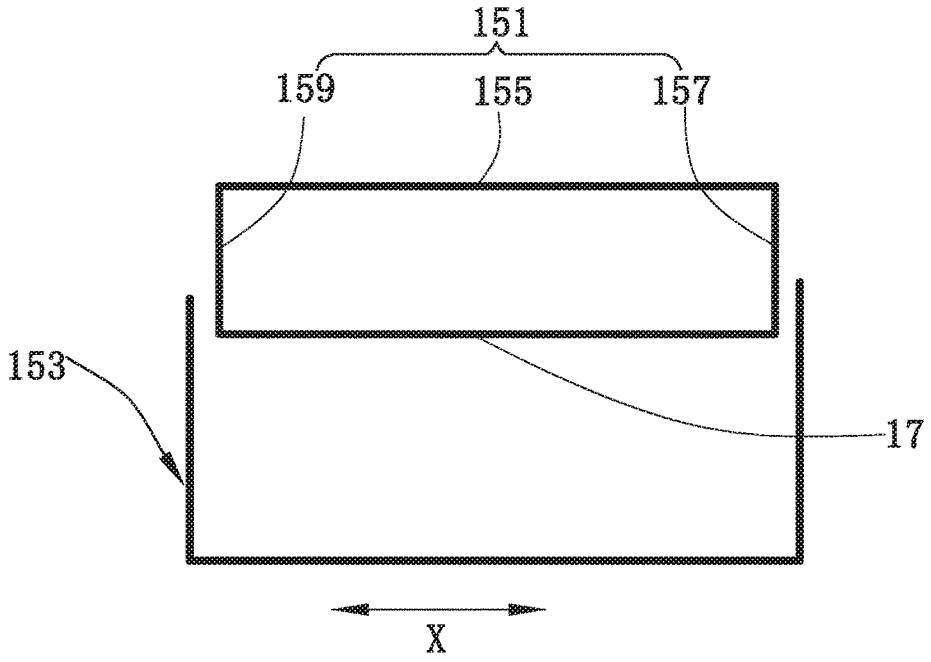
FIG. 11 is a schematic structural diagram of a fourth embodiment of a first connector.

As shown in FIG. 11 which only illustrates the shielding component and the outer terminal, the difference between the fourth embodiment and the first embodiment is as following: the shielding component 17 has an integral structure, and both ends of the shielding component 17 are integrated to the first transverse side 157 and the second transverse side 159 of the first outer terminal 151, respectively. In other words, the shielding component 17 and the first outer terminal 151 are integrally formed as one piece.

Embodiment V

Figure 12:
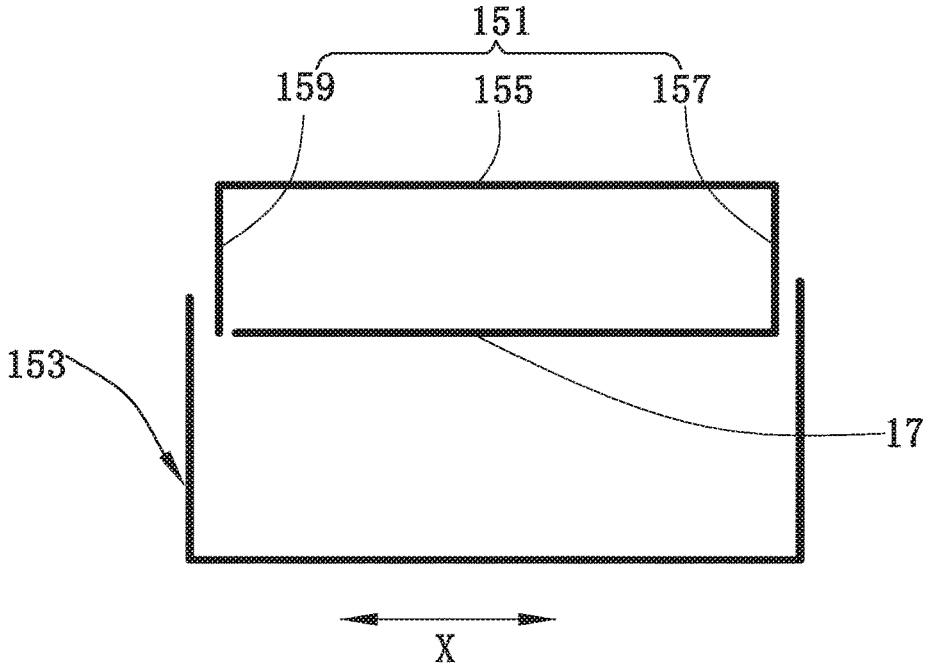
FIG. 12 is a schematic structural diagram of a fifth embodiment of a first connector.

As shown in FIG. 12 which only illustrates the shielding component and the outer terminal, the difference between the fifth embodiment and the fourth embodiment is as following: the shielding component 17 extends from the first transverse side 157 of the first outer terminal 151 to the second transverse side 159 of the first outer terminal 151 along the X direction. An end of the shielding component 17 away from the first transverse side 157 of the first outer terminal 151 can be separated from the second transverse side 159 of the first outer terminal 151, or can be in contact with the second transverse side 159 of the first outer terminal 151. In other words, the shielding component 17 and the first outer terminal 151 are integrally formed as one piece.

Embodiment VI

Figure 13:
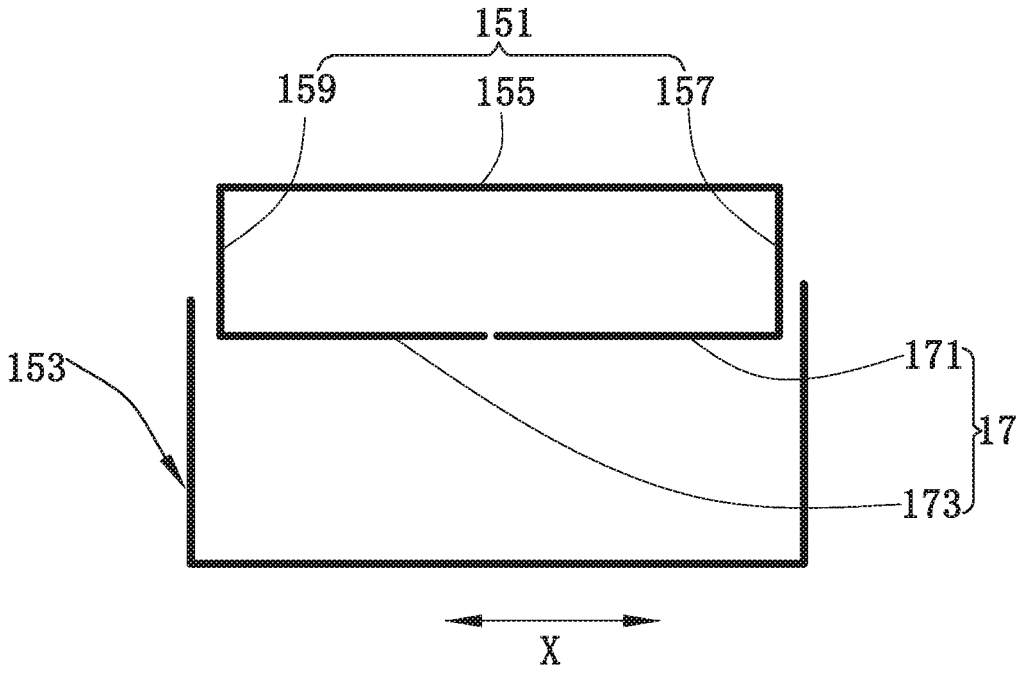
FIG. 13 is a schematic structural diagram of a sixth embodiment of a first connector.

As shown in FIG. 13 which only illustrates the shielding component and the outer terminal, the difference between the sixth embodiment and the first embodiment is as following: the first shielding part 171 extends from the first transverse side 157 of the first outer terminal 151 along the X-direction, and the second shielding part 173 extends from the second transverse side 159 of the first outer terminal 151 along the X-direction. In other words, the first shielding part 171, the second shielding part 173, and the first outer terminal 151 are integrally formed as one piece.

Embodiment VII

Figure 14:
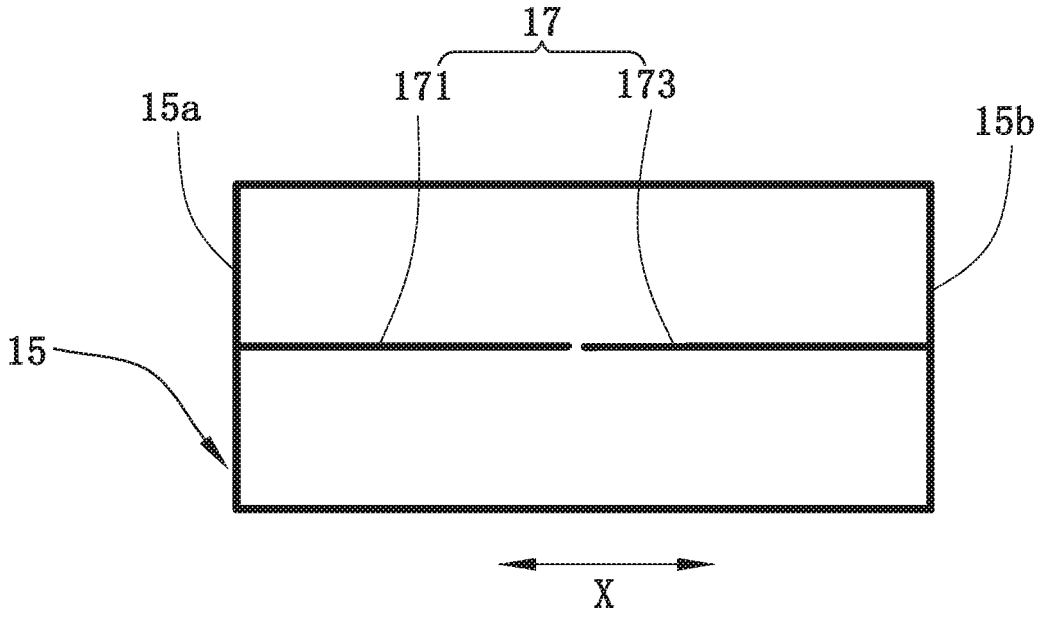
FIG. 14 is a schematic structural diagram of a seventh embodiment of a first connector.

As shown in FIG. 14 which only illustrates the shielding component and the outer terminal, the difference between the seventh embodiment and the first embodiment is as following: the outer terminal 15 has a continuous ring-shaped configuration surrounding the inner terminal 11. The outer terminal 15 includes a first sidewall 15*a* and a second side wall 15*b* oppositely arranged along the X direction. The first shielding part 171 extends from the first side wall 15*a* of the outer terminal 15 along the X direction, and the second shielding part 173 extends from the second side wall 15*b* of the outer terminal 15 along the X direction. In other words, the first shielding part 171, the second shielding part 173, and the outer terminal 15 are integrally formed as one piece.

Embodiment VIII

Figure 15:
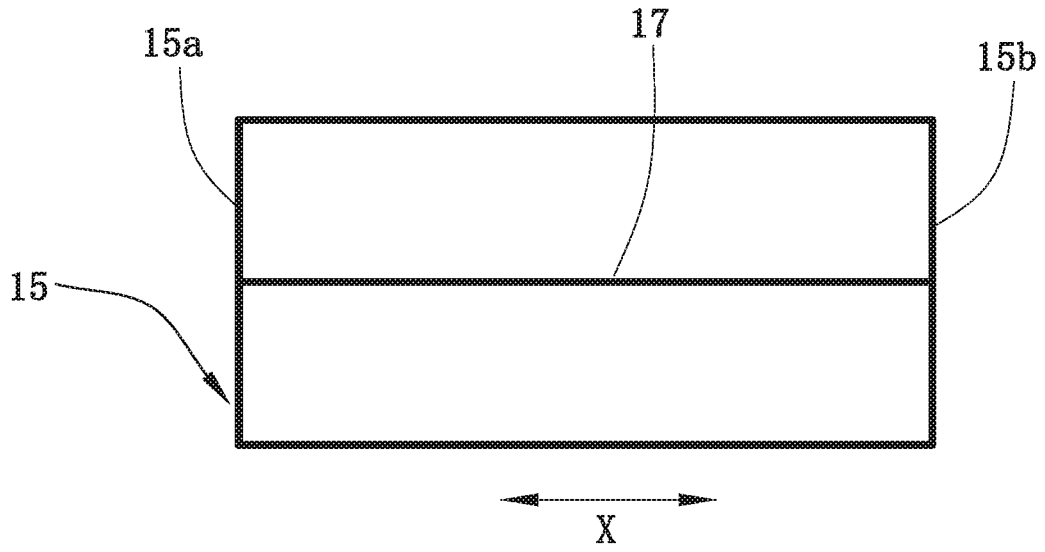
FIG. 15 is a schematic structural diagram of an eighth embodiment of a first connector.

As shown in FIG. 15 which only illustrates the shielding component and the outer terminal, the difference between the eighth embodiment and the seventh embodiment is as following: the shielding component 17 has an integral structure, and two ends of the shielding component 17 are integrated to the first sidewall 15*a* and the second side wall 15*b*, respectively. In other words, the shielding component 17 and the first outer terminal 151 are integrally formed as one piece.

Embodiment IX

Figure 16:
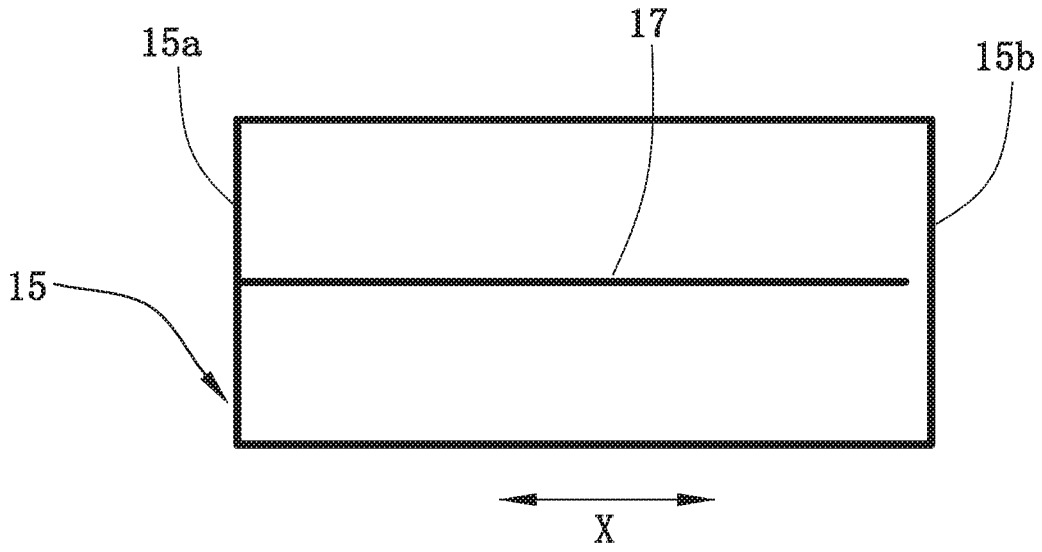
FIG. 16 is a schematic structural diagram of a ninth embodiment of a first connector.

As shown in FIG. 16 which only illustrates the shielding component and the outer terminal, the difference between the ninth embodiment and the seventh embodiment is as following: the shielding component 17 has an integral structure, and the shielding component 17 extends from the first transverse side 15*a* of the first outer terminal 151 to the second transverse side 15*b* of the first outer terminal 151 along the X direction. An end of the shielding component 17 away from the first transverse side 15*a* can be separated from the second transverse side 15*b*, or can be in contact with the second transverse side 15*b*. In other words, the shielding component 17 and the first outer terminal 151 are integrally formed as one piece.

In the above-mentioned embodiments (the first embodiment to the ninth embodiment), the outer terminal and the shielding component are formed in the first connector, but the present disclosure is not limited to these embodiments. In other embodiments, both the first connector and the second connector can be provided with the outer terminal and the shielding component, wherein the shielding component of the first connector and the shielding component of the second connector are arranged between adjacent columns of inner terminals, and the shielding component of the first connector and the shielding component of the second connector can be in contact with or be separated from each other. In the embodiment of the shielding component of the first connector and the shielding component of the second connector being separated from each other, electromagnetic shielding can be constructed when the shielding component of the first connector and the shielding component of the second connector are close to each other. The arrangement of the outer terminal and the shielding component of the second connector is similar to the arrangement of the outer terminal and the shielding component of the first connector (the integral construction of the outer terminal and the shielding component described in any one of the first to ninth embodiments).

In the above-mentioned embodiments (the first embodiment to the ninth embodiment), the outer terminal of the first connector has a continuous ring-shaped structure or is consisted of separately formed the first outer terminal and the second outer terminal. It is understood that the outer terminal is not limited to the above-mentioned arrangement. For example, in other embodiments, the outer terminal may further include a third outer terminal and a fourth outer terminal. The first outer terminal, the second outer terminal, the third outer terminal, and the fourth outer terminal cooperatively form the outer terminal surrounding the inner terminals, wherein the first outer terminal and the second outer terminal are located at two opposite sides of the plurality of inner terminals along the X direction, and the third outer terminal and the fourth outer terminal are located between the first outer terminal and the second outer terminal.

Compared with the related arts, the multipolar connector of the present disclosure integrates the shielding component and the outer terminal as one piece to avoid the issue that the shielding component is difficult to be accurately located when the shielding component is separately inserted into the insulating component (inaccurate location of the shielding component when the shielding component is separately inserted into the insulating component will weaken the shielding and isolation effect of shielding component), so as to improve the shielding effect.

The above are only embodiments of the present disclosure. It should be noted that those of ordinary skill in the art can make improvements without departing from the inventive concept of the present disclosure, but these improvements should be within the protection scope of the present disclosure.

The invention claimed is:

1. A multipolar connector comprising:

a first connector comprising a plurality of inner terminals arranged in a plurality of columns and an insulating component holding the inner terminals, and a second connector engaged with the first connector, the second connector comprising a plurality of inner terminals arranged in a plurality of columns and an insulating component holding the inner terminals, wherein at least one of the first connector and second connector further comprises an outer terminal held by the insulating component thereof and configured to be electrically connected to a ground potential; and wherein a shielding component extends from the outer terminal along an extending direction of the columns of inner terminals and is held by the insulating component of the at least one of the first connector and second connector, and the shielding component is located between adjacent columns of inner terminals when the inner terminals of the first connector and second connector are respectively in contact and engaged with each other;

the outer terminal comprises a first outer terminal and a second outer terminal, the first outer terminal and the second outer terminal each comprises a longitudinal side extending along the extending direction of the columns of inner terminals, and a first transverse side and a second transverse side extending from opposite ends of the longitudinal side respectively, two longitudinal sides, two first transverse sides, and two second transverse sides cooperate to form a ring-shaped configuration surrounding the inner terminals.

2. The multipolar connector of claim 1, wherein the shielding component comprises a first shielding part and a second shielding part arranged along the extending direction of the columns of inner terminals.

3. The multipolar connector of claim 2, wherein the first shielding part and the second shielding part are in contact with each other.

4. The multipolar connector of claim 1, wherein the shielding component has an integral structure.

5. The multipolar connector of claim 1, wherein and the shielding component is located between the first outer terminal and the second outer terminal.

6. The multipolar connector of claim 5, wherein the shielding component and one of the first outer terminal and the second outer terminal are integrally formed as one piece.

7. The multipolar connector of claim 5, wherein the shielding component, the first outer terminal and the second outer terminal are integrally formed as one piece.

8. The multipolar connector of claim 5, wherein the first transverse side being shorter than the second transverse side, the shielding component extending from at least one of the first transverse sides.

9. The multipolar connector of claim 8, wherein the second transverse side of the first outer terminal faces and is close to the first transverse side of the second outer terminal, and the second transverse side of the second outer terminal faces and is close to the first transverse side of the first outer terminal.

10. The multipolar connector of claim 1, wherein only the first connector of the first and second connectors comprises the outer terminal and the shielding component, the insulating component of the first connector defines an annular-shaped groove, the groove divides the insulating component of the first connector into a peripheral portion and a central portion, the outer terminal is held by the peripheral portion, and the shielding component is held by the central portion.

11. The multipolar connector of claim 10, wherein the insulating component of the second connector defines a slot, the central portion is received in the slot and a sidewall of the slot is inserted into the groove when the inner terminals of the first connector and second connector are in contact and engaged with each other.

* * * * *